US009267215B2

(12) United States Patent
Wang et al.

(10) Patent No.: US 9,267,215 B2
(45) Date of Patent: Feb. 23, 2016

(54) SYSTEM, METHOD AND APPARATUS FOR MEASURING ELECTROLYSIS CELL OPERATING CONDITIONS AND COMMUNICATING THE SAME

(71) Applicants: Xiangwen Wang, Sarver, PA (US); Robert Hosler, Sarver, PA (US); Gary Tarcy, Murrysville, PA (US)

(72) Inventors: Xiangwen Wang, Sarver, PA (US); Robert Hosler, Sarver, PA (US); Gary Tarcy, Murrysville, PA (US)

(73) Assignee: ALCOA INC., Pittsburgh, PA (US)

( * ) Notice: Subject to any disclaimer, the term of this patent is extended or adjusted under 35 U.S.C. 154(b) by 101 days.

(21) Appl. No.: 13/854,231

(22) Filed: Apr. 1, 2013

(65) Prior Publication Data

US 2013/0319874 A1 Dec. 5, 2013

Related U.S. Application Data

(62) Division of application No. 12/411,639, filed on Mar. 26, 2009, now Pat. No. 8,409,409.

(51) Int. Cl.

| | |
|---|---|
| ***C25C 3/14*** | (2006.01) |
| ***C25C 3/06*** | (2006.01) |
| ***C25C 3/08*** | (2006.01) |
| ***C25D 21/12*** | (2006.01) |
| ***C25C 3/20*** | (2006.01) |
| ***C25C 7/06*** | (2006.01) |

(52) U.S. Cl.
CPC ... *C25C 7/06* (2013.01); *C25C 3/14* (2013.01); *C25C 3/20* (2013.01); *C25D 21/12* (2013.01)

(58) Field of Classification Search
CPC ..... C25C 3/20; C25C 3/14; C25C 7/06
USPC ..... 204/228.6, 229.8, 243.1; 205/334–336
See application file for complete search history.

(56) References Cited

U.S. PATENT DOCUMENTS

| | | | | |
|---|---|---|---|---|
| 6,065,867 | A * | 5/2000 | Sulmont et al. | 374/139 |
| 6,926,814 | B2 * | 8/2005 | Koenemann et al. | 204/409 |
| 2007/0295615 | A1 * | 12/2007 | Wang et al. | 205/775 |
| 2008/0251233 | A1 * | 10/2008 | Mortimer et al. | 164/493 |

OTHER PUBLICATIONS

Russian Patent Office; Translation of Office Action issued in connection to counterpart Russian Patent Application No. 2011143139; 9 pages; Russia.

Russian Patent Office; Translation of Decision on Grant issued in connection to counterpart Russian Patent Application No. 2011143139; 4 pages; Russia.

* cited by examiner

*Primary Examiner* — Nicholas A Smith
*Assistant Examiner* — Brian W Cohen
(74) *Attorney, Agent, or Firm* — Greenberg Traurig LLP

(57) ABSTRACT

System, method and apparatus for measuring electrolysis cell operating conditions and communicating the same are disclosed. The system includes a selectively positionable member coupled to an analytical apparatus, wherein the selectively positionable is configured to move the analytical apparatus into and out of physical communication with a bath. The system may also include a crust breaker for breaking the surface of a bath and an electronic device for measuring bath level.

10 Claims, 7 Drawing Sheets

SYSTEM, METHOD AND APPARATUS FOR MEASURING ELECTROLYSIS CELL OPERATING CONDITIONS AND COMMUNICATING THE SAME

CROSS REFERENCE TO RELATED APPLICATIONS

This application is a divisional application and claims the benefit and priority benefit of U.S. patent application Ser. No. 12/411,639, filed Mar. 26, 2009, now U.S. Pat. No. 8,409,409 titled "SYSTEM, METHOD AND APPARATUS FOR MEASURING ELECTROLYSIS CELL OPERATING CONDITIONS AND COMMUNICATING THE SAME," the disclosure of which is incorporated herein in its entirety.

BACKGROUND

Aluminum electrolysis cells operating conditions may be controlled by measuring cell temperature and bath electrolyte chemistry since cell temperature and bath chemistry are closely related to each other. Bath chemistry may be controlled to its target by knowing the operating temperature, and similarly, electrolysis cells may run more efficient with proper control of the bath chemistry.

SUMMARY

System, method and apparatus for measuring electrolysis cell operating conditions and communicating the same are disclosed. In one embodiment, a system for measuring electrolysis cell operating conditions and communicating the same comprises a metal electrolysis cell comprising a bath. The system also includes a selectively positionable member coupled to an analytical apparatus. The selectively positionable member is capable of moving the analytical apparatus from a first position to a second position. In the first position the analytical apparatus is not in physical communication with the bath. In the second position the analytical apparatus is in physical communication with the bath. In one embodiment, the analytical apparatus is configured to measure at least one operating condition related to the bath and communicate the measured operating condition to a host computer through a network.

In one embodiment, an electronic device may be coupled to at least one of the selectively positionable member and the analytical apparatus. The electronic device is capable of detecting a delta between the first position and the second position, and communicating the delta to the host computer through the network. In one embodiment, the analytical apparatus and the electronic device are integrated. In one embodiment, the selectively positionable member, the analytical apparatus and the electronic device are automated.

In one embodiment, the operating condition comprises bath superheat, bath temperature, bath constituent concentration, bath constituent ratio, and bath level. In one example, the metal electrolysis cell is an aluminum electrolysis cell, the bath constituent concentration is the concentration of alumina, and the bath constituent ratio is the ratio of sodium fluoride to aluminum fluoride. In one embodiment, a discharge member may be coupled to the metal electrolysis cell, whereby the discharge member is configured to discharge bath from at least a portion of the analytical apparatus. In one example, the discharge member uses compressed air.

In one embodiment, the selectively positionable member is capable of moving the analytical apparatus from the second position to a third position. In the third position the analytical apparatus is not in physical communication with the bath. In one embodiment, the analytical apparatus comprises a holder for holding at least a portion of the bath, whereby in the third position the analytical apparatus is not holding the bath. In one embodiment, the first position and the third position are above bath level and the second position is below bath level.

In one embodiment, a method for measuring electrolysis cell operating conditions and communicating the same comprises operating a metal electrolysis cell comprising a bath. Next, moving an analytical apparatus using a selectively positionable member from a first position to a second position. In the first position the analytical apparatus is not in physical communication with the bath. In the second position the analytical apparatus is in physical communication with the bath. Subsequently, at least one operating condition related to the bath can be measured using the analytical apparatus and communicated to a host computer through a network.

In one embodiment, the a delta can be detected between the first position and the second position using an electronic device. This detected delta can be communicated to the host computer through the network. In one embodiment, the analytical apparatus and the electronic device are integrated. In one embodiment, the selectively positionable member, the analytical apparatus and the electronic device are automated.

In one embodiment, the operating condition comprises bath superheat, bath temperature, bath constituent concentration, bath constituent ratio, and bath level. In one example, the metal electrolysis cell is an aluminum electrolysis cell, the bath constituent concentration is the concentration of alumina, and the bath constituent ratio is the ratio of sodium fluoride to aluminum fluoride.

In one embodiment, the analytical apparatus can be discharged with a discharge member coupled to the metal electrolysis cell. In one instance, the discharging comprises spraying the analytical apparatus with compressed air. In one embodiment, the analytical apparatus can be moved using the selectively positionable member from the second position to a third position. In the third position the analytical apparatus is not in physical communication with the bath. In one embodiment, the first position and the third position are above bath level and the second position is below bath level.

Other variations, embodiments and features of the presently disclosed system, method and apparatus for measuring electrolysis cell operating conditions and communicating the same will become evident from the following detailed description, drawings and claims.

DETAILED DESCRIPTION

It will be appreciated by those of ordinary skill in the art that the system, method and apparatus for measuring electrolysis cell operating conditions and communicating the same can be embodied in other specific forms without departing from the spirit or essential character thereof. The presently disclosed embodiments are therefore considered in all respects to be illustrative and not restrictive.

Figure 1:
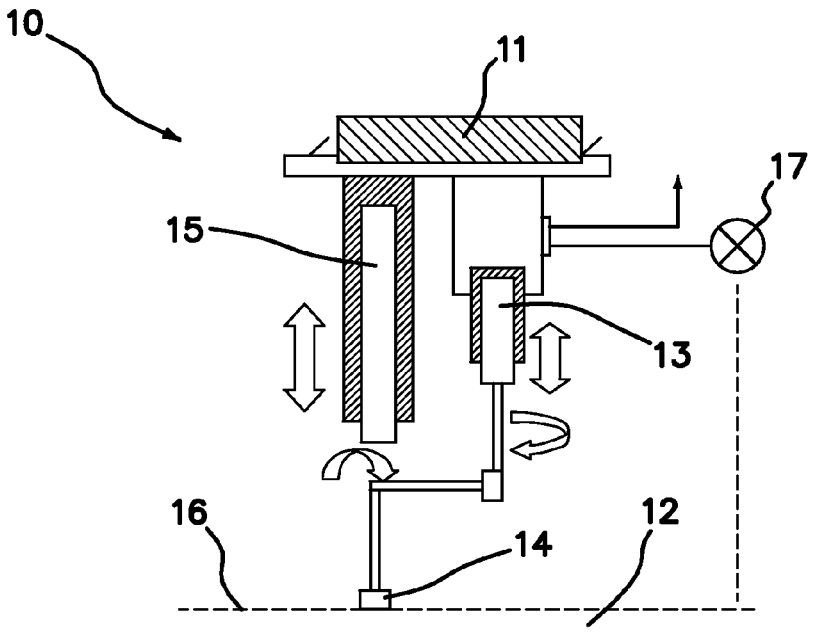
FIG. 1 is a system for measuring electrolysis cell operating conditions and communicating the same according to one embodiment of the present disclosure.

FIG. 1 illustrates a system 10 for measuring electrolysis cell operating conditions and communicating the same according to one embodiment of the present disclosure. The system 10 includes a metal electrolysis cell 11 comprising a bath 12 and a selectively positionable member 13 coupled to an analytical apparatus 14. The selectively positionable member 13 is operable to move the analytical apparatus 14 from a first position to a second position. In one embodiment, the first position is when the analytical apparatus 14 is not in physical communication with the bath 12 and the second position is when the analytical apparatus 14 is in physical communication with the bath 12.

In one embodiment, the analytical apparatus 14 is configured to measure at least one operating condition related to the bath 12 and communicate the measured operating condition to a host computer through a network. In one embodiment, the first position is above bath level 16 and the second position is below bath level 16. This will become more apparent in subsequent figures and discussion.

As used herein, "metal electrolysis cell" and the like means an electrolysis cell for decomposing chemical compounds by means of electrical energy. For example, metallic aluminum can be produced by an electrolysis process in an aluminum electrolysis cell. "Bath" and the like means a vessel containing liquid in which something is immersed. For example, a bath may contain molten chemicals in which a bath probe may be immersed for measuring an operating condition related to the bath. "Selectively positionable member" and the like means any member that may be selectively positioned so as to facilitate operation of an analytical apparatus. For example, the selectively positionable member may be any of a robotic arm, motorized arm, step motor, sensor and controller, air pneumatic and positioning device, and corresponding hardware and software for operating the selectively positionable member. "Analytical apparatus" and the like means any apparatus capable of measuring and analyzing at least one operating conditions associated with the metal electrolysis cell and communicating the same. For example, the analytical apparatus may comprise a bath probe and associated computing hardware and software, wherein the analytical apparatus may be selectively automated or computerized to wirelessly communicate a measured operating condition to a network computer. "Physical communication" means the act of conveying information electronically or by physical contact and touching. "Host computer" and the like means a network computer or server dedicated to running at least one application. In some instances, the host computer may include associated database, hardware and software for controlling the metal electrolysis cell, selectively positionable member and analytical apparatus. "Network" and the like means an interconnected communication system. For example, the Internet, a company's Intranet or local area network (LAN), and the World Wide Web are networks.

The operating conditions capable of being measured by the analytical apparatus 14 include bath superheat, bath temperature, bath constituent concentration, bath constituent ratio, and bath level 16. As used herein, "bath level" and the like means the position (e.g., height) of the molten bath surface 16. In one embodiment, the bath superheat, constituent concentration and constituent ratio may be measured when the analytical apparatus 14 is not in physical communication with the bath 12 (e.g., above the bath level 16). In one embodiment, the bath temperature may be measured when the analytical apparatus 14 is in physical communication with the bath 12 (e.g., below the bath level 16). In one embodiment, the metal electrolysis cell 11 is an aluminum electrolysis cell, the bath constituent concentration is the concentration of alumina, and the bath constituent ratio is the ratio of sodium fluoride to aluminum fluoride.

In one embodiment, the system 10 includes a crust breaker 15 capable of breaking through the bath surface 16. As shown, the crust breaker 15 may be coupled to the metal electrolysis cell 11. In some embodiments, the crust breaker 15 may be coupled to the selectively positionable member 13, or the analytical apparatus 14, or both. The crust breaker 15 may be necessary to facilitate analytical apparatus 14 access to the bath 12. For example, when a solid layer of crust forms on the bath surface 16. In one embodiment, the bath 12 includes molten cryolite containing dissolved alumina.

In one embodiment, the system 10 includes an electronic device 17 coupled to at least one of the selectively positionable member 13 and the analytical apparatus 14. In one embodiment, the electronic device 17 detects a delta between the first and second positions and communicates the detected delta to the host computer through the network. As used herein, "electronic device" and the like means electronic hardware and software capable of sensing, sending and receiving electronic signals and communicating the same to a host computer through a network, the electronic device includes without limitation sensors, controllers, and associated modules for engaging the selectively positionable member 13 and analytical apparatus 14.

For example, a closed circuit may be formed when the analytical apparatus 14 is in physical communication with the bath 12. In the alternative, an open circuit may be formed when the analytical apparatus 14 is not in physical communication with the bath 12. In one embodiment, the electronic device 17 detects the presence of at least one of the selectively positionable member 13 and the analytical apparatus 14 at various positions, e.g., the first position and the second position. In some embodiments, the electronic device 17 detects the presence of at least one of the selectively positionable member 13 and the analytical apparatus 14 at other positions. As used herein, "delta" and the like means the difference from one position to the next. For example, the delta between two positions may be determined by detecting horizontal and vertical positioning of the analytical apparatus 14 at the first position. The first position of the analytical apparatus 14 may be determined with respect to an object including the likes of the selectively positionable member 13 or other objects around the metal electrolysis 11. Once the first position has been determined (e.g., horizontal and vertical positioning), the analytical apparatus 14 may then be moved from the first position to the second position by the selectively positionable member 13. The electronic device 17 may subsequently determine the second position of the analytical apparatus 14 and calculating the same based on horizontal and vertical differences.

Figure 2:
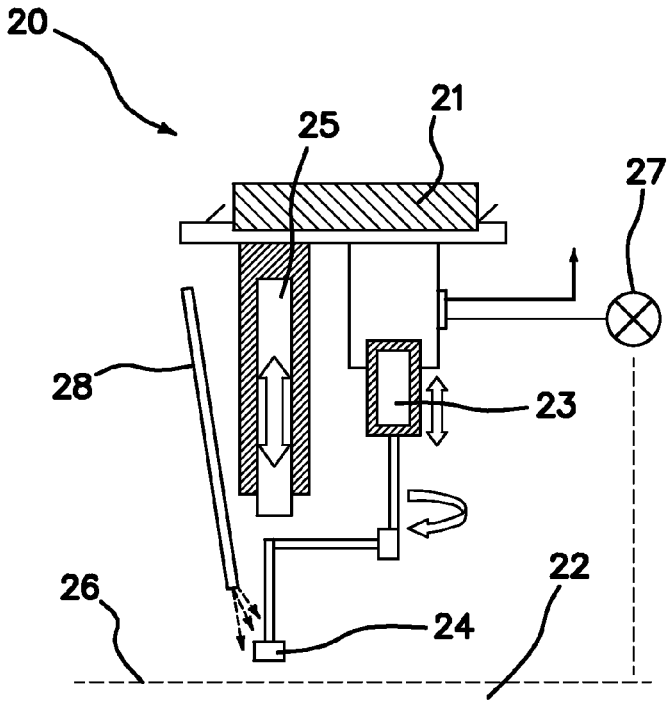
FIG. 2 is a system for measuring electrolysis cell operating conditions and communicating the same according to one embodiment of the present disclosure.
Figure 3C:
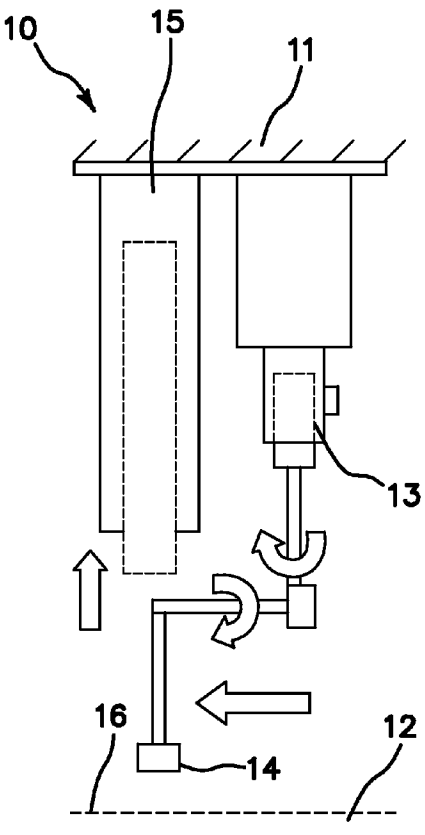
FIGS. 3(*a*)-3(*l*) illustrate measurement sequences using the systems of FIGS. 1 and 2.
Figure 3B:
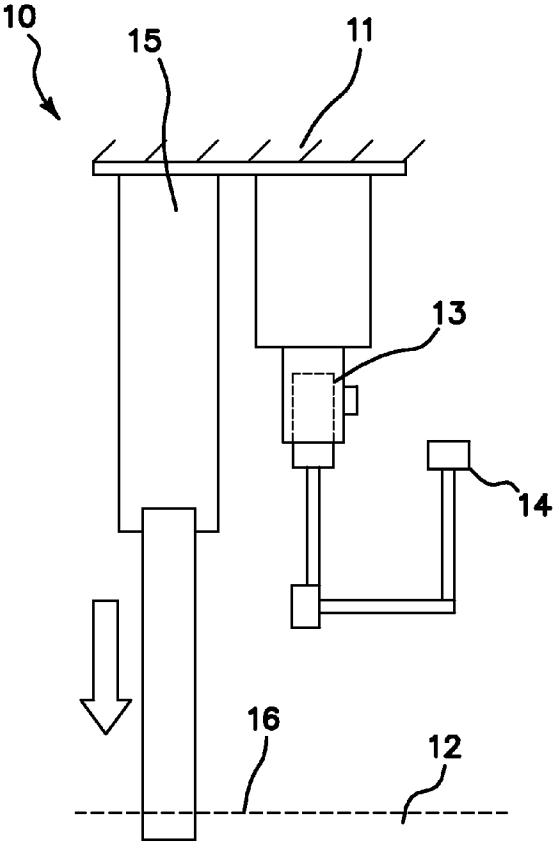
Figure 3A:
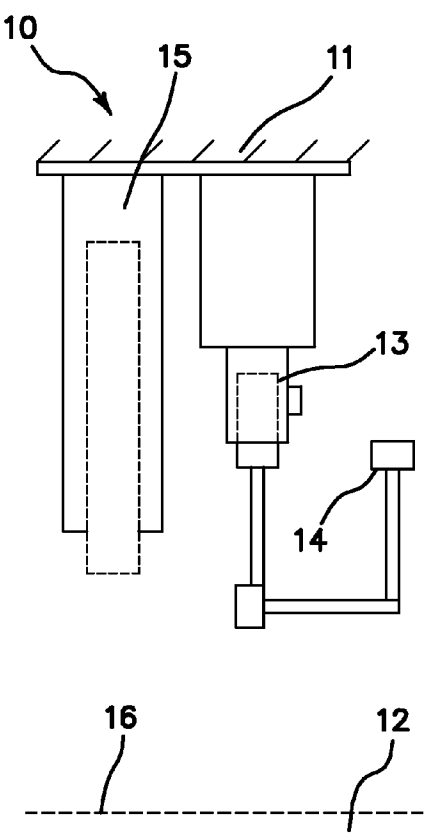
Figure 3F:
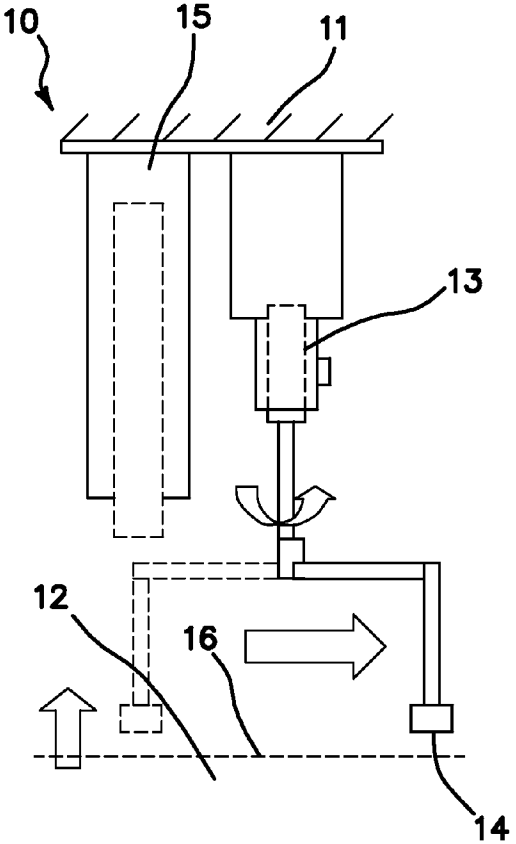
Figure 3E:
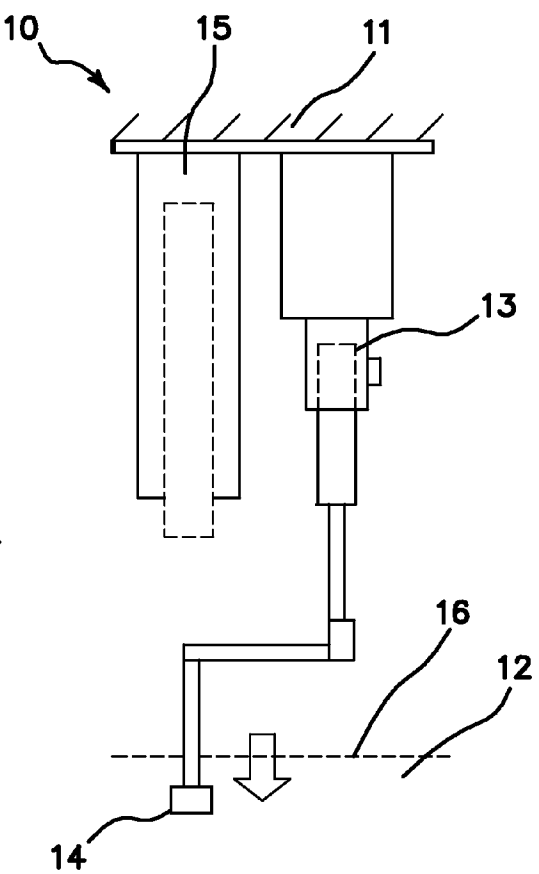
Figure 3D:
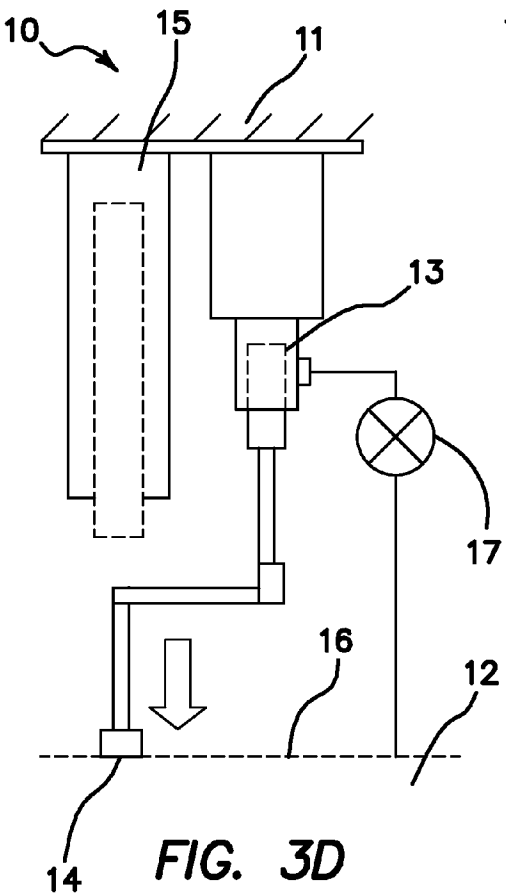
Figure 3I:
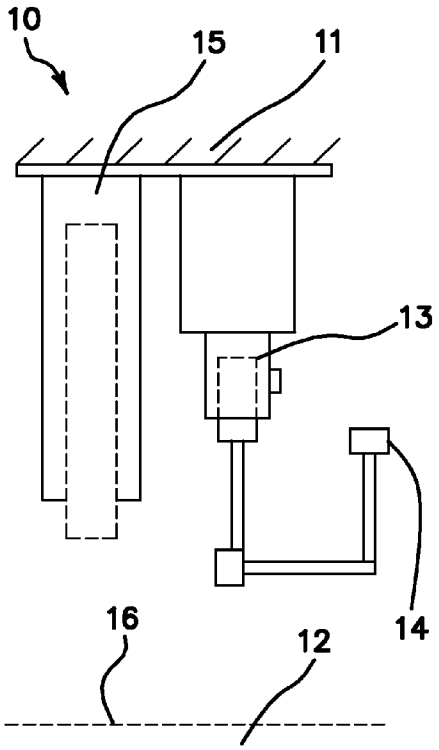
Figure 3H:
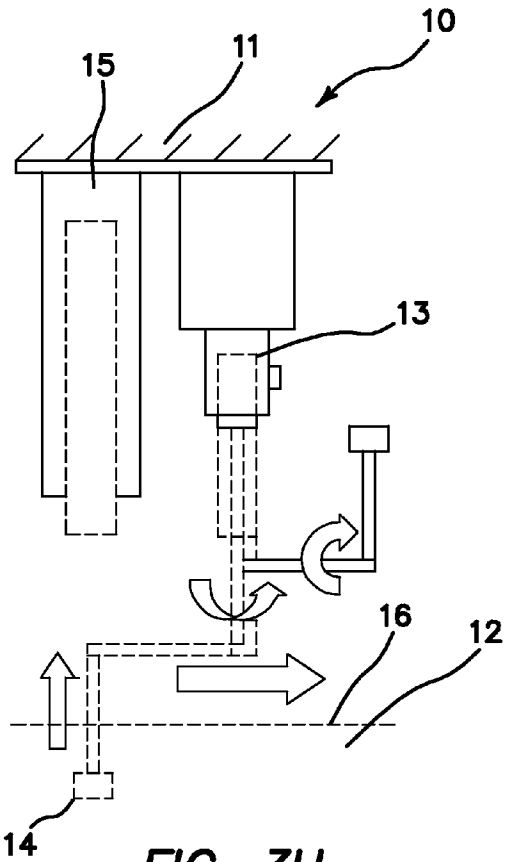
Figure 3G:
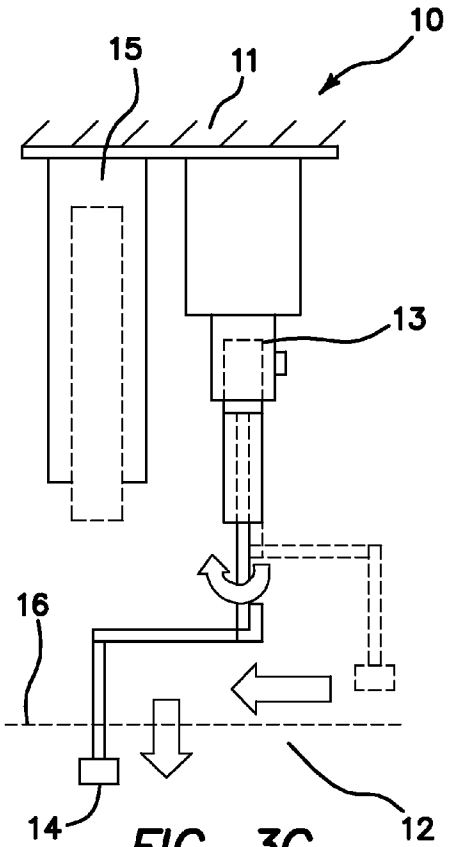
Figure 3L:
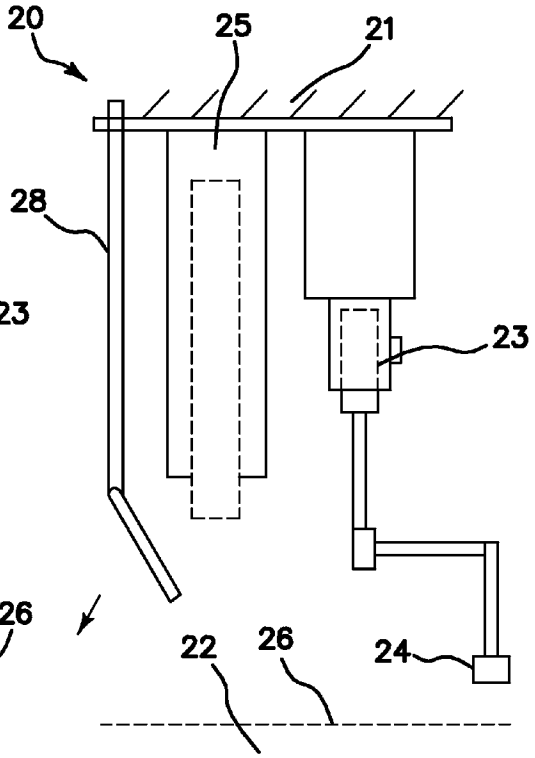
Figure 3K:
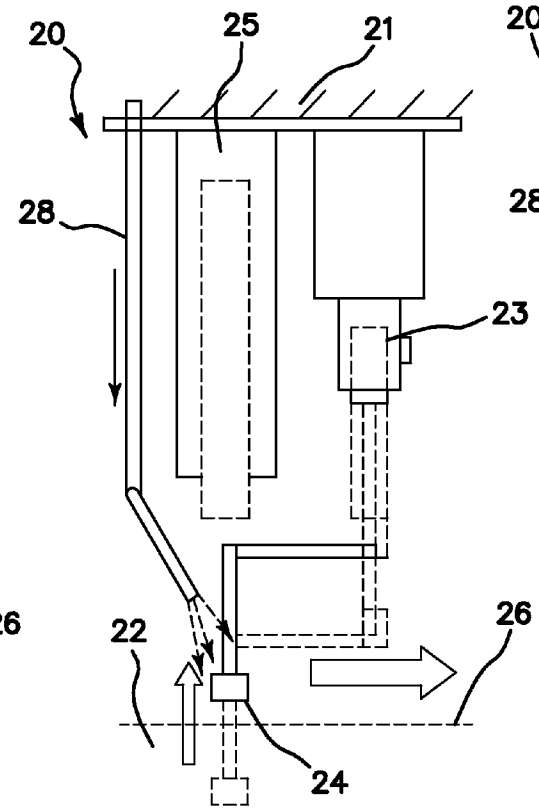
Figure 3J:
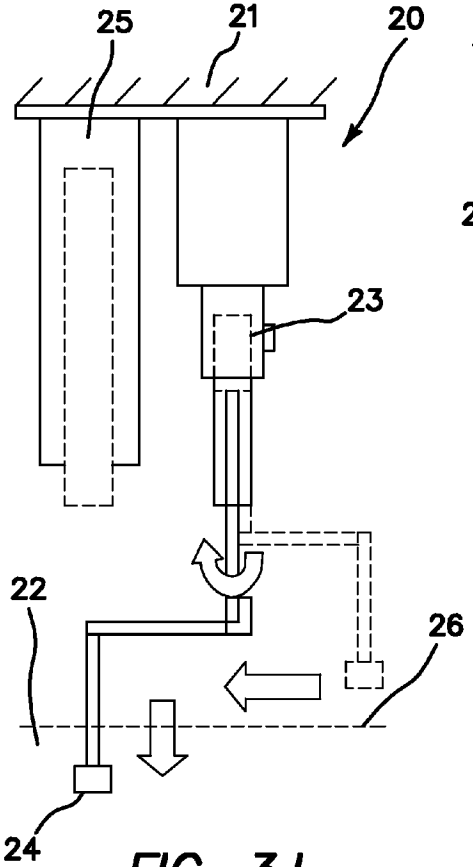

FIG. 2 illustrates a system 20 for measuring electrolysis cell operating conditions and communicating the same according to one embodiment of the present disclosure. This system 20, being substantially similar to the previous system 10, includes a metal electrolysis cell 21 comprising a bath 22 and a selectively positionable member 23 coupled to an analytical apparatus 24. In one embodiment, a crust breaker 25 may be coupled to the electrolysis cell 21 to facilitate the analytical apparatus 24 access to the bath 22 by breaking any solidified crust at a bath surface 26. In one embodiment, an electronic device 27 may be coupled to the system 20 for measuring a delta between a first position and a second position of the analytical apparatus 24, and communicating the same to a host computer through a network. Like above, the selectively positionable member 23 is operable to move the analytical apparatus 24 from a first position to a second position. In one embodiment, the analytical apparatus 24 is not in physical communication with the bath 22 in the first position and the analytical apparatus 24 is in physical communication with the bath 22 in the second position. In one embodiment, the analytical apparatus 24 is in physical communication with the bath 22 in the first position and the analytical apparatus 24 is not in physical communication with the bath 22 in the second position. In some embodiments, the analytical apparatus 24 is not in physical communication with the bath 22 in both the first position and the second position, or the analytical apparatus 24 is in physical communication with the bath 22 in both the first position and the second position.

In one embodiment, the analytical apparatus 24 is configured to measure at least one operating condition related to the bath 22 and communicate the measured operating condition to a host computer through a network. In one embodiment, the first position is above the bath level 26 and the second position is below the bath level 26. In one embodiment, the first position is below the bath level 26 and the second position is above the bath level 26. In some embodiments, the first position and the second position are both above the bath level 26, or the first position and the second position are both below the bath level 26. This will become more apparent in subsequent figures and discussion.

In one embodiment, the system 20 includes a discharge member 28 coupled to the metal electrolysis cell 21, wherein the discharge member 28 is configured to clean the analytical apparatus 24. As used herein, "discharge member" and the like means an object capable of discharging a material to facilitate cleaning of the analytical apparatus 24. For example, a discharge member may comprise a spray gun or nozzle for cleaning an analytical apparatus. In one embodiment, the analytical apparatus 24 is a bath probe and may be cleaned by the discharge member 28, which may be a spray gun capable of blowing compressed air on the bath probe for discharging bath from at least a portion of the bath probe. In one embodiment, the analytical apparatus 24 is able to discharge at least a portion of the bath from the analytical apparatus 24 with assistance of the discharge member 28.

In one embodiment, the selectively positionable member 23 is operable to move the analytical apparatus 24 from a second position to a third position, wherein in the third position the analytical apparatus 24 is not in physical communication with the bath 22. In some embodiments, the second position and the third position are above the bath level 26, or at least one of the second position and the third position may be above the bath level 26 and the other may be below the bath level 26. In one example, the analytical apparatus 24 comprises a holder for holding at least a portion of the bath, and wherein in the third position the analytical apparatus 24 is not holding the bath. In one embodiment, the selectively positionable member 23 is capable of moving the analytical apparatus 24 from the second position to the third position, wherein the analytical apparatus 24 is able to self-discharge at least a portion of the bath from the analytical apparatus 24 based on the horizontal and vertical positioning of the analytical apparatus 24 as moved to and from by the selectively positionable member 23.

FIGS. 3(*a*)-3(*i*) illustrate one measurement sequence of at least one bath operating condition using the presently disclosed system 10. In FIG. 3(*a*), the system 10 and associated selectively positionable member 13, analytical apparatus 14, and crust breaker 15 are at their respective initial positions. In FIG. 3(*b*), the crust breaker 15 is extended downward and breaks through a bath surface 16 in preparing the analytical apparatus 14 for measuring an operating condition of the bath 12. In the alternative, this step may not be necessary if there are no crust buildups at the bath surface 16. In FIG. 3(*c*), the crust breaker 15 is retracted and the analytical apparatus 14 is moved into a measuring position by the selectively positionable member 13. In one embodiment, the analytical apparatus 14 is a bath probe and the selectively positionable member 13 is a robotic arm capable of rotational and translational movements in vertical and/or horizontal directions. In one embodiment, the analytical apparatus 14 is at a first position being above the bath surface 16 as shown in FIG. 3(*c*).

In FIG. 3(*d*), the analytical apparatus 14 is lowered by the selectively positionable member 13 into the bath 12, wherein the analytical apparatus 14 is in physical communication with the bath 12. In one embodiment, when the analytical apparatus 14 makes physical contact with the bath surface 16, a closed circuit may be formed with an electronic device 17, the selectively positionable member 13, the analytical apparatus 14, and the bath 12. In one embodiment, the electronic device 17 may be in physical communication with the bath 12 or at least a vessel containing the bath 12, the selectively positionable member 13, and the analytical apparatus 14 in completing the circuit. In one embodiment, the analytical apparatus 14 and the electronic device 17 may be integrated as a single device. In one embodiment, the selectively positionable member 13, the analytical apparatus 14 and the electronic device 17 are automated. As used herein, "integrated" and the like means formed or united into a whole. For example, the analytical apparatus 14 and the electronic device 17 may be integrated as a single unit. "Automated" and the like means the act of implementing control of equipment with electronic hardware and software. For example, the selectively positionable member 13, the analytical apparatus 14 and the electronic device 17 may be automated and controlled by a host computer through a network.

In one embodiment, because of the closed circuit, the electronic device 17 is capable of determining the physical location of the analytical apparatus 14 at its position. For example, the electronic device 17 is capable of recording the location of the analytical apparatus 14 based on horizontal and/or vertical positioning of the analytical apparatus 14 with respect to the metal electrolysis cell 11. In some embodiments, the electronic device 17 is capable of determining the physical position of the analytical apparatus 14 relative to other objects including the selectively positionable member 13, or the vessel containing the bath 12, to name a few.

In FIG. 3(*e*), the analytical apparatus 14 is translated downward or extended further into the bath 12 by the selectively positionable member 13. In one embodiment, because the selectively positionable member 13 is capable of controlling the analytical apparatus 14, the amount of horizontal and/or vertical travel by the analytical apparatus 14 may be recorded by the selectively positionable member 13. In one embodiment, the amount of horizontal and/or vertical travel by the analytical apparatus 14 may be recorded by the analytical apparatus 14. In one embodiment, the recorded horizontal and/or vertical travel may be communicated to the electronic device 17 or to the host computer through the network. In one embodiment, while the analytical apparatus 14 is below the bath surface 16, the analytical apparatus 14 may measure at least one operating condition associated with the bath 12 and communicate the same to the host computer through the network. In some embodiments, the communication may be carried out via the analytical apparatus 14 or the electronic device 17, to name a few.

In FIG. 3(*f*), after the analytical apparatus 14 has completed the desired measurement or measurements, the analytical apparatus 14 may be retracted or lifted up out of the bath 12 by the selectively positionable member 13. In one embodiment, when the analytical apparatus 14 is no longer making physical contact or in physical communication with the bath 12, the circuit is open and the electronic device 17 is capable of detecting the same. In one embodiment, because of the closed/open circuit system and the relationship among the electronic device 17, the selectively positionable member 13, the analytical apparatus 14, the bath 12, and the metal electrolysis cell 11, the presently disclosed system 10 may be capable of measuring the bath level 16 and communicating the same to a host computer or network computer. In other words, the disclosed system 10 may be capable of determining depth and volume of the bath 12. In some embodiments, the analytical apparatus 14 may be moved to a position for cooling in preparation for carrying out additional measurements of at least one operating conditions of the bath 12 including, without limitation, bath superheat, bath temperature, bath constituent concentration, bath constituent ratio, and bath level.

In FIG. 3(*g*), the analytical apparatus 14 is moved back into the bath 12 for additional measurements. As shown, the selectively positionable member 13 is capable of manipulating the analytical apparatus in horizontal and/or vertical directions by rotational and translational movements. In one embodiment, the analytical apparatus 14 may be moved into the bath 12 for bath remelting. In one embodiment, the analytical apparatus 14 is capable of acquiring at least a portion of the bath 12 (e.g., the bath's molten chemicals). The steps for measuring the various operating conditions of the bath 12 may be repeated or carried out as many times as necessary.

In FIG. 3(*h*), the analytical apparatus 14 is retracted or moved out of the bath 12 being substantially similar to that of FIG. 3(*f*). In one embodiment, the analytical apparatus 14 is capable of being moved to a third position in which the analytical apparatus 14 self-cleans or discharges at least a portion of the bath from the analytical apparatus 14. In other words, the analytical apparatus 14 may be manipulated to a position where it is capable of self-removing molten chemicals contained therein (e.g., by dumping the sample bath contained within). In some embodiments, this self-cleaning process may be carried out with the assistance of the selectively positionable member 13 using rotational and translational movements.

In FIG. 3(*i*), the analytical apparatus 14 may be returned to its initial position by the selectively positionable member 13 in preparation for subsequent measurements.

FIGS. 3(*j*)-3(*l*) illustrate some processing steps of at least one bath operating condition using the presently disclosed system 20. In one embodiment, the system 20 includes a bath 22, a selectively positionable member 23, an analytical apparatus 24, a crust breaker 25 for breaking a bath surface 26, and an electronic device 27 to facilitate the open/closed circuit system similar to that described above. In one embodiment, the processing steps as outlined by FIGS. 3(*a*)-3(*f*) are substantially similar and may be incorporated for this system 20. Like above, after the analytical apparatus 24 has completed a measurement as shown in FIGS. 3(*a*)-3(*f*), the analytical apparatus 24 may be moved into the bath 22 by the selectively positionable member 23 for additional measurement of at least one operating condition of the metal electrolysis cell 21 as illustrated in FIG. 3(*j*). As shown, the selectively positionable member 23 is capable of manipulating the analytical apparatus 24 in horizontal and/or vertical directions by rotational and translational movements. In one embodiment, the analytical apparatus 24 is capable of being moved into the bath 22 for bath remelting. In one embodiment, the analytical apparatus 24 is capable of acquiring at least a portion of the bath 22 (e.g., the bath's molten chemicals). Like above, the steps for measuring the various operating conditions of the bath 22 (FIGS. 3(*a*)-3(*f*)) may be repeated or carried out as many times as necessary in this system 20.

In FIG. 3(*k*), the analytical apparatus 24 may be retracted or moved out of the bath 22 being substantially similar to that of FIGS. 3(*f*) and 3(*h*). In one embodiment, the analytical apparatus 24 is capable of being moved to a third position in which the discharge member 28 is capable of cleaning the analytical apparatus 24. As shown, the analytical apparatus 24 may be sprayed with compressed air (or other suitable material) from the discharge member 28 for removing at least a portion of molten chemicals contained therein. In one embodiment, the spray cleaning of the analytical apparatus 24 may be carried out with the assistance of the selectively positionable member 23.

In FIG. 3(*l*), the analytical apparatus 24 may be returned to an initial position by the selectively positionable member 23 in preparation for subsequent measurements. Likewise, the discharge member 28 may also be returned to its initial or rest position in preparation for subsequent cleaning of the analytical apparatus.

Figure 4:
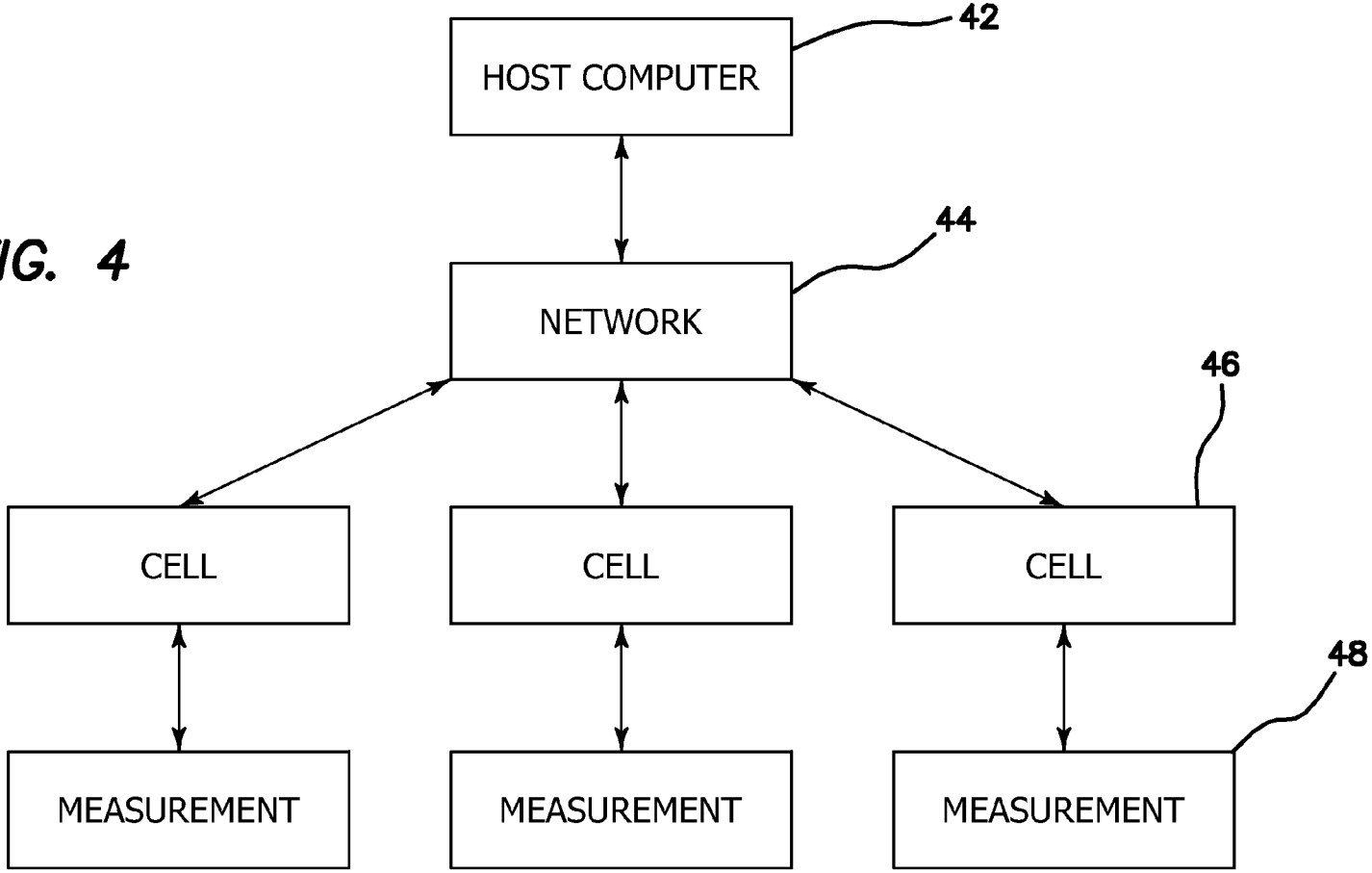
FIG. 4 is an overview of a system for measuring electrolysis cell operating conditions and communicating the same according to one embodiment of the present disclosure.

FIG. 4 is a block diagram of an overview of a system for measuring electrolysis cell operating conditions and communicating the same. In one embodiment, a host computer 42 may be configured to control at least one electrolysis cell 46 and operating conditions 48 of each of the electrolysis cells 46. In one embodiment, the host computer 42 may be configured to control at least one of selectively positionable member including robotic components, setups and controls. In one embodiment, the host computer 42 may be configured to manipulate the electrolysis cell 46 based on bath temperatures and other operating conditions. This may be carried out via a network 44 including the likes of the Internet, or office intranet, and other similar network systems. In some embodiments, the communication may be wired or wireless. In one embodiment, a series of electrolysis cells 46 and associated measurement components 48 may be coupled to the host computer 42 via the network 44. In some embodiments, the host computer 42 may be coupled to additional computer systems on the network, sometimes referred to as network computers (not shown).

In one embodiment, a measurement 48 may be carried out within an electrolysis cell 46 by elements previously described including, without limitation, one or more selectively positionable member, one or more analytical apparatus, one or more electronic device, one or more crust breaker, and one or more discharge member. These elements, along with other associated electronic and mechanical components, may be coupled to the electrolysis superstructure or cell 46. In some embodiments, the associated electronic and mechanical components include one or more transducers, one or more input/output modules, one or more input/output thermal modules, one or more pot control minicomputers, one or more standalone microcomputer for the one or more analytical apparatus, one or more pneumatic components for the one or more crust breaker, and one or more continuous positioning system (positioner), to name a few.

Once the components have been coupled, robotic operations may be carried out using the selectively positionable member with minimal input from operators to perform a series of actions including crust breaking to allow a probe tip access to a molten bath, moving the probe tip to a position for measuring at least one operating condition associated with the cell 46, removing the probe tip from the bath, and cleaning the probe tip with the discharge member, to name a few. In one embodiment, the operating condition includes bath superheat, bath temperature, bath constituent concentration, bath constituent ratio, and bath level. In one embodiment, the measurements may be automatically carried out at anytime. In one embodiment, the operations described above, along with other operations, may be carried out via wireless communication to the host computer 42 via the network 44. In some embodiments, the host computer 42 may be disposed about a server and controlled by at least one remote computer.

Figure 5:
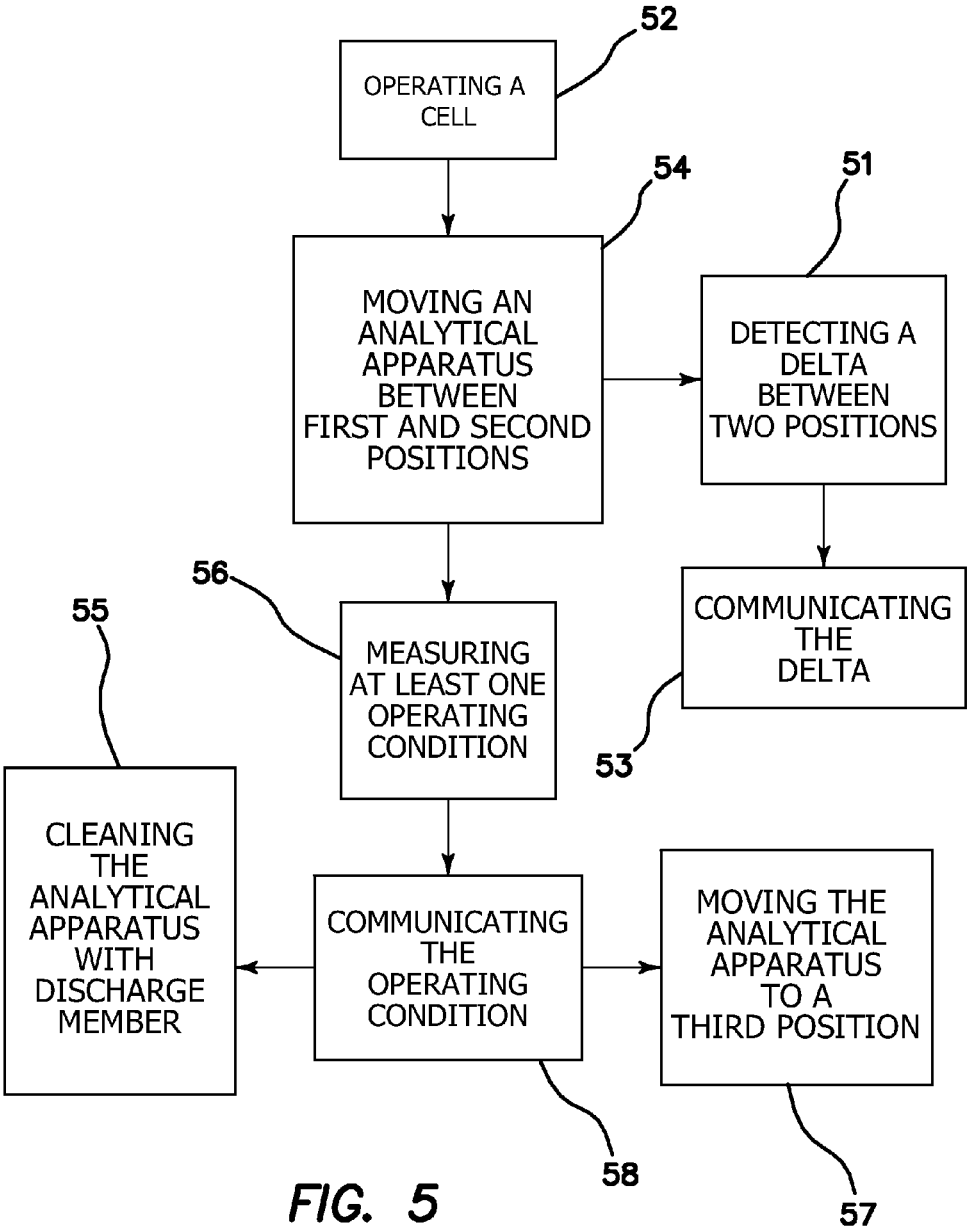
FIG. 5 is a block diagram outlining various methods of measuring electrolysis cell operating conditions and communicating the same according to the present disclosure.

FIG. 5 is a block diagram outlining various methods of measuring electrolysis cell operating conditions and communicating the same according to the present disclosure. One method starts by operating a metal electrolysis cell 52. The metal electrolysis cell may include a bath, a selectively positionable member, an analytical apparatus, and a discharge member, among others. In one embodiment, the metal electrolysis cell is an aluminum electrolysis cell. The analytical apparatus may be moved using the selectively positionable member from a first position to a second position 54, wherein in the first position the analytical apparatus is not in physical communication with the bath, and wherein in the second position the analytical apparatus is in physical communication with the bath.

At least one operating condition related to the bath may be measured 56 using the analytical apparatus. The operating condition comprises at least one of bath superheat, bath temperature, bath constituent concentration, bath constituent ratio, and bath level. In one embodiment, the bath constituent concentration is the concentration of alumina and the bath constituent ratio is the ratio of sodium fluoride to aluminum fluoride. The operating condition information may be communicated 58 to a host computer through a network.

In one embodiment, the metal electrolysis cell includes an electronic device coupled to at least one of the selectively positionable member and the analytical apparatus, wherein the electronic device is capable of detecting a delta between the first position and the second position 51. In one embodiment, the analytical apparatus and the electronic device are integrated. In one embodiment, the selectively positionable member, the analytical apparatus and the electronic device are automated. The delta may be communicated 53 to the host computer through the network.

In one embodiment, the metal electrolysis cell includes a discharge member. The discharge member is capable of cleaning the analytical apparatus 55. In one example, the discharging comprises spraying the analytical apparatus with compressed air.

In one embodiment, the selectively positionable member is capable of moving the analytical apparatus to a third position 57. In the third position the analytical apparatus is not in physical communication with the bath. In one embodiment, the first position and the third position are above bath level and the second position is below bath level. In one embodiment, the analytical apparatus comprises a holder for holding at least a portion of the bath, and wherein in the third position the analytical apparatus is not holding the bath.

The presently disclosed systems, methods and apparatus may provide the following advantages or benefits over traditional/conventional sampling analysis methods. In one embodiment, the system and method may combine several lengthy and laborious measurement procedures into a single step because bath samples typically requires sampling, processing and analyzing results which may take anywhere from 6 hours to two days, for example. In one embodiment, the operating condition of the cell, which is necessary for effective pot control, including superheat, temperature, alumina concentration and ratio may be automatically measured because bath sampling, transporting to analytical lab and subsequent analysis are no longer required. Furthermore, the traditional sampling and analysis methods do not and cannot provide superheat information.

In one embodiment, labor costs may be reduced because the bath samples need no longer be acquired manually, for example. In one embodiment, the cost and maintenance of analytical equipment including the likes of XRD, XRF and/or Leco analyzer may be eliminated if the analysis may be completed automatically by the analytical apparatus. In one embodiment, mass sampling and handling as well as potential sample mix-up may be reduced. In one embodiment, pot control decisions may be determined instantaneously instead of waiting for sample analysis since analytical results fed to a computer may take a long time to process, for instance. In one embodiment, measurement parameters may be used for making pot control decisions rather than calculated parameters since measurements may be carried out in real-time. In one embodiment, the process of identifying problematic pots (such as hot and cold pots) may be expedited and if it is chemistry related, the correction to bring the pots back to normal operating conditions may be expedited as well, since electrolyte composition changes with input materials and pot temperature changes. In one embodiment, a measurement can be carried out whenever the control system deems necessary. In one embodiment, the system and method may lead to increased pot performance including increased current efficiency and energy efficiency. In one embodiment, sidewall failures may be reduced due to better management of pot thermal balance (due to availability of bath superheat information).

Although the system, method and apparatus for measuring electrolysis cell operating conditions and communicating the same have been described in detail with reference to several embodiments, additional variations and modifications exist within the scope and spirit as described and defined in the following claims.

What is claimed is:

1. A method comprising:

operating a metal electrolysis cell comprising a bath and a selectively positionable member coupled to the metal electrolysis cell;

moving an analytical apparatus using the selectively positionable member from a first position to a second position, wherein in the first position the analytical apparatus is not in physical communication with the bath, wherein in the second position the analytical apparatus is in physical communication with the bath, and wherein the bath has a bath surface and the selectively positionable member comprises an arm having a plurality of independently moveable arm segments including a first arm segment that is capable of rotational movement about a vertical axis with respect to the bath surface, a second arm segment that is coupled to the first arm segment and capable of rotational movement about a horizontal axis with respect to the bath surface, and a third arm segment that is coupled to the second arm segment but not independently moveable with respect to the second arm segment, such that the third arm segment exhibits rotational movement about a horizontal axis with respect to the bath surface when the second arm segment exhibits rotational movement about a horizontal axis with respect to the bath surface;

measuring at least one operating condition related to the bath using the analytical apparatus; and communicating the operating condition to a host computer through a network.

2. The method of claim 1, further comprising: detecting a delta between the first position and the second position using an electronic device.

3. The method of claim 2, further comprising: communicating the delta to the host computer through the network.

4. The method of claim 2, wherein the analytical apparatus and the electronic device are integrated, and wherein the selectively positionable member, the analytical apparatus and the electronic device are automated.

5. The method of claim 2, wherein the operating condition comprises bath superheat, bath temperature, bath constituent concentration, bath constituent ratio, and bath level.

6. The method of claim 5, wherein the metal electrolysis cell is an aluminum electrolysis cell, wherein the bath constituent concentration is the concentration of alumina, and wherein the bath constituent ratio is the ratio of sodium fluoride to aluminum fluoride.

7. The method of claim 1, further comprising: discharging the analytical apparatus with a discharge member, wherein the discharge member is coupled to the metal electrolysis cell.

8. The method of claim 7, wherein the discharging comprises: spraying the analytical apparatus with compressed air.

9. The method of claim 1, further comprising moving the analytical apparatus using the selectively positionable member from the second position to a third position, wherein in the third position the analytical apparatus is not in physical communication with the bath.

10. The method of claim 9, wherein the first position and the third position are above bath level and the second position is below bath level.

* * * * *